US008016572B2

(12) United States Patent
Chaffee

(10) Patent No.: US 8,016,572 B2
(45) **Date of Patent: *Sep. 13, 2011**

(54) PUMP WITH AXIAL CONDUIT

(76) Inventor: Robert B. Chaffee, Boston, MA (US)

( * ) Notice: Subject to any disclaimer, the term of this patent is extended or adjusted under 35 U.S.C. 154(b) by 293 days.

This patent is subject to a terminal disclaimer.

(21) Appl. No.: 11/339,025

(22) Filed: Jan. 25, 2006

(65) Prior Publication Data

US 2006/0127241 A1 Jun. 15, 2006

Related U.S. Application Data

(63) Continuation of application No. 10/113,836, filed on Apr. 1, 2002, now Pat. No. 7,025,576, and a continuation-in-part of application No. 09/859,706, filed on May 17, 2001, now Pat. No. 7,039,972, and a continuation-in-part of application No. PCT/US01/15834, filed on May 17, 2001.

(60) Provisional application No. 60/280,257, filed on Mar. 30, 2001, provisional application No. 60/280,040, filed on Mar. 30, 2001.

(51) Int. Cl.
*F04B 17/03* (2006.01)
*A47C 27/08* (2006.01)

(52) U.S. Cl. ..... 417/366; 417/423.14; 5/655.3

(58) Field of Classification Search ..... 417/366, 417/423.14, 423.7, 423.15, 423.1; 5/655.3
See application file for complete search history.

(56) References Cited

U.S. PATENT DOCUMENTS

| | | | | |
|---|---|---|---|---|
| 1,451,136 | A | 4/1923 | Allnut | |
| 3,026,909 | A | 3/1962 | Boteler | |
| 3,068,494 | A | 12/1962 | Pinkwater | |
| 3,099,386 | A | 7/1963 | Pieper | |
| 3,112,502 | A | 12/1963 | Forsberg | |
| 3,142,850 | A | 8/1964 | DeBoer | |
| 3,505,695 | A | 4/1970 | Bishaf et al. | |
| 3,563,676 | A | 2/1971 | Coovert et al. | |
| 3,995,653 | A | 12/1976 | Mackal et al. | |
| 4,080,105 | A | 3/1978 | Connell | |
| 4,146,069 | A | 3/1979 | Angarola et al. | |
| 4,146,070 | A | 3/1979 | Angarola et al. | |
| 4,213,745 | A | 7/1980 | Roberts | |
| 4,225,989 | A | 10/1980 | Corbett et al. | |
| 4,521,166 | A | 6/1985 | Phillips | |
| 4,678,014 | A * | 7/1987 | Owen et al. | 141/67 |

(Continued)

FOREIGN PATENT DOCUMENTS

| | | |
|---|---|---|
| CN | 2037006 U | 5/1989 |

(Continued)

OTHER PUBLICATIONS

An English translation of a First Notification of Office Action from the Intellectual Property Office of the People's of China, mailed Aug. 6, 2004.

(Continued)

*Primary Examiner* — Charles G Freay

(74) *Attorney, Agent, or Firm* — Lando & Anastasi, LLP

(57) ABSTRACT

In one aspect, a pump for moving air includes an inlet, an outlet, an outer housing adapted to couple to an inflatable device, and an inner housing located within the outer housing. An air conduit is defined between the inner housing and the outer housing. A motor is at least partly positioned within the inner housing, and a plurality of vanes are positioned within the air conduit.

35 Claims, 5 Drawing Sheets

U.S. PATENT DOCUMENTS

| | | | | | |
|---|---|---|---|---|---|
| 4,678,410 | A | | 7/1987 | Kullen | |
| 4,692,091 | A | | 9/1987 | Ritenour | |
| 4,734,017 | A | | 3/1988 | Levin | |
| 4,829,616 | A | | 5/1989 | Walker | |
| 4,862,533 | A | * | 9/1989 | Adams, III | 5/413 R |
| 4,890,344 | A | | 1/1990 | Walker | |
| 4,897,890 | A | | 2/1990 | Walker | |
| 4,977,633 | A | * | 12/1990 | Chaffee | 5/706 |
| 4,982,466 | A | | 1/1991 | Higgins et al. | |
| 4,986,738 | A | | 1/1991 | Kawasaki et al. | |
| 4,990,060 | A | | 2/1991 | Cheng-Chung | |
| 5,051,060 | A | | 9/1991 | Fleischmann et al. | |
| 5,052,894 | A | | 10/1991 | Rimington | |
| 5,068,933 | A | | 12/1991 | Sexton | |
| 5,144,708 | A | | 9/1992 | Pekar | |
| 5,170,522 | A | | 12/1992 | Walker | |
| 5,203,808 | A | | 4/1993 | Ide | |
| 5,249,319 | A | | 10/1993 | Higgs | |
| 5,267,363 | A | | 12/1993 | Chaffee | |
| 5,367,726 | A | * | 11/1994 | Chaffee | 5/706 |
| 5,406,661 | A | | 4/1995 | Pekar | |
| 5,494,418 | A | | 2/1996 | Moriya et al. | |
| 5,503,618 | A | * | 4/1996 | Rey | 601/15 |
| 5,511,942 | A | * | 4/1996 | Meier | 415/220 |
| 5,598,593 | A | | 2/1997 | Wolfe | |
| 5,727,270 | A | | 3/1998 | Cope et al. | |
| 5,746,873 | A | | 5/1998 | Graf | |
| 5,857,841 | A | | 1/1999 | Kobayashi et al. | |
| 5,890,882 | A | | 4/1999 | Feldman | |
| 5,893,609 | A | | 4/1999 | Schmidt | |
| 5,903,941 | A | | 5/1999 | Shafer et al. | |
| 6,099,248 | A | | 8/2000 | Mumm et al. | |
| 6,108,844 | A | | 8/2000 | Kraft et al. | |
| 6,129,524 | A | * | 10/2000 | Woollenweber et al. | 417/366 |
| 6,206,654 | B1 | * | 3/2001 | Cassidy | 417/312 |
| 6,237,653 | B1 | | 5/2001 | Chaffee | |
| D446,284 | S | | 8/2001 | Chaffee | |
| 6,287,095 | B1 | | 9/2001 | Saputo et al. | |
| 6,296,459 | B1 | | 10/2001 | Saputo et al. | |
| 6,332,760 | B1 | * | 12/2001 | Chung | 417/411 |
| 6,483,264 | B1 | | 11/2002 | Shafer et al. | |
| 6,530,751 | B1 | | 3/2003 | Song et al. | |
| 6,543,073 | B2 | | 4/2003 | Wu | |
| 6,565,315 | B1 | | 5/2003 | Bertels et al. | |
| 6,571,412 | B1 | | 6/2003 | Wu | |
| 6,651,283 | B1 | * | 11/2003 | Cook et al. | 5/713 |
| 6,659,737 | B2 | | 12/2003 | Bader et al. | |
| 6,679,686 | B2 | | 1/2004 | Wang | |
| 6,709,246 | B2 | | 3/2004 | Boyd | |
| 6,722,306 | B1 | | 4/2004 | Wang | |
| 6,733,254 | B1 | | 5/2004 | Yen | |
| 6,793,469 | B2 | | 9/2004 | Chung | |
| 6,836,914 | B1 | | 1/2005 | Tsai | |
| 7,025,576 | B2 | * | 4/2006 | Chaffee | 417/366 |
| 7,039,972 | B2 | * | 5/2006 | Chaffee | 5/706 |
| 2001/0026763 | A1 | | 10/2001 | Chung | |
| 2001/0044969 | A1 | | 11/2001 | Chaffee | |
| 2002/0194678 | A1 | | 12/2002 | Chung | |
| 2003/0003001 | A1 | | 1/2003 | Chaffee | |
| 2003/0024050 | A1 | | 2/2003 | Boso et al. | |
| 2003/0099560 | A1 | | 5/2003 | Wang | |
| 2003/0215340 | A1 | | 11/2003 | Chung | |
| 2004/0037717 | A1 | | 2/2004 | Wang | |
| 2004/0241014 | A1 | | 12/2004 | Yen | |
| 2005/0047923 | A1 | | 3/2005 | Li et al. | |
| 2005/0118046 | A1 | | 6/2005 | Wang | |
| 2005/0186097 | A1 | | 8/2005 | Wang | |

FOREIGN PATENT DOCUMENTS

| | | | |
|---|---|---|---|
| CN | 1274266 | A | 11/2000 |
| DE | 1808122.6 | | 5/1970 |
| DE | 44 13 445 | | 10/1995 |
| DE | 297 21 150 | | 2/1998 |
| JP | S54-24711 | | 1/1979 |
| JP | 05137809 | | 6/1993 |
| JP | 3023725 | | 2/1996 |
| JP | H8-93683 | | 4/1996 |
| JP | H11-182439 | | 7/1999 |
| WO | WO 93/05684 | | 4/1993 |
| WO | WO 03/093709 | | 11/2003 |

OTHER PUBLICATIONS

Imaginair by Aero, Instruction Manual, Dec. 1999, Imaginair Incorporated, Wauconda, IL, USA.

Imaginair Aero Product Catalog, 2000 Imaginair Incorporated, Wauconda, IL, USA.

Supreme Fast-Fill, 2000 Intex Recreation Corp., Long Beach, CA USA.

Image of Aero product—inflatable bed; approx. 2002.

PCT International Search Report mailed Jul. 7, 2002.

PCT International Search Report mailed Dec. 6, 2001.

* cited by examiner

PUMP WITH AXIAL CONDUIT

CROSS REFERENCE TO RELAED APPLICATION

This application is a continuation and claims priority under 35 U.S.C. §120 to commonly-owned, co-pending U.S. patent application Ser. No. 10/113,836, filed Apr. 1, 2002 which claims priority under 35 U.S.C. §119(e), to U.S. Provisional Patent Application Nos. 60/280,257 and 60/280,040, both filed on Mar. 30, 2001, and is a Continuation-In-Part of U.S. patent application Ser. No. 09/859,706, filed May 17, 2001, and is a Continuation-In-Part of International PCT Application No. US01/15834, filed May 17, 2001, the contents of which are all hereby incorporated herein by reference in their entirety.

BACKGROUND

1.Field of the Invention

The present invention is related to pumps and, more specifically, to pumps for use with inflatable devices.

2.Related Art

A variety of methods of providing air or other fluids to inflatable devices have been proposed. Typically a pump is used to supply air to an orifice in the inflatable device. Such pumps may include a motor that drives an impeller, moving the air into the inflatable device. Motorized pumps may be powered by electricity. Typically, such electricity is provided by a connection to standard house current or, where portability is desired, by batteries.

SUMMARY

In one aspect, a pump for moving air includes an inlet, an outlet, an outer housing adapted to couple to an inflatable device, and an inner housing located within the outer housing. An air conduit is defined between the inner housing and the outer housing. A motor is at least partly positioned within the inner housing, and a plurality of vanes are positioned within the air conduit.

According to one embodiment, the air conduit is located annularly about an axis of the pump. In another embodiment, the pump includes an impeller which is located outside the air conduit defined between the inner housing and the outer housing.

In a further embodiment, the inflatable device includes an inflatable bladder, the pump is adapted to engage with a valve assembly, and a majority of the pump and a majority of the valve assembly are positioned within a profile of the inflatable bladder when the pump is engaged with the valve assembly.

In another aspect, a pump for moving air includes an inlet, an outlet, an outer housing adapted to couple to an inflatable device, and an inner housing located within the outer housing. An air conduit is defined between the inner housing and the outer housing. A motor is at least partly positioned within the inner housing and a vane is positioned within the air conduit. The air conduit is located annularly about an axis of the pump for a majority of a distance between the inlet and the outlet.

BRIEF DESCRIPTION OF DRAWINGS

The foregoing and other advantages of the present invention will be more fully appreciated with reference to the following drawings in which.

DETAILED DESCRIPTION

Figure 1:
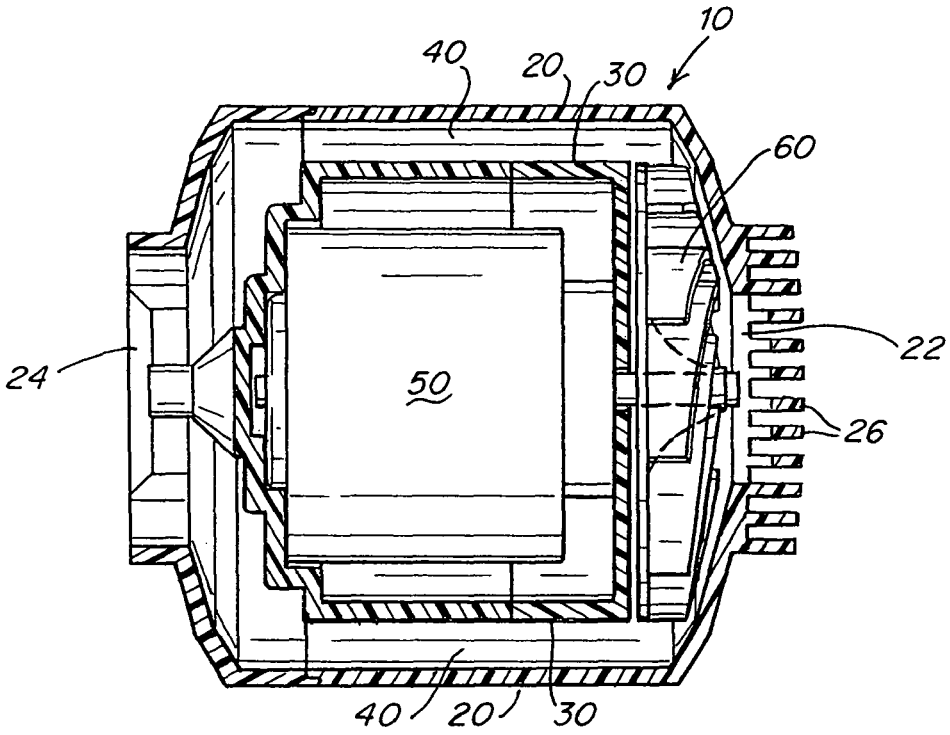
FIG. 1 is a cross-sectional, elevational view of a pump according to one embodiment of the present invention.
Figure 2:
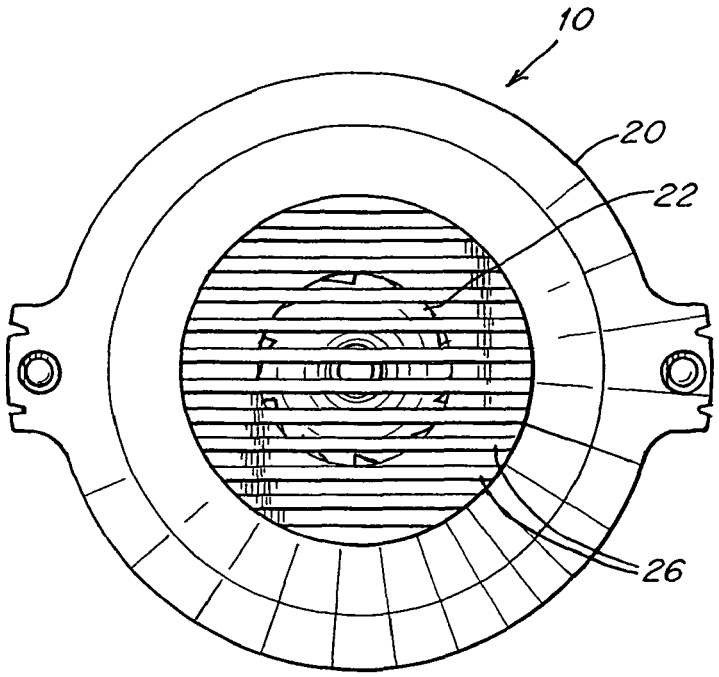
FIG. 2 is an axial, elevational view of the pump of FIG. 1.

The present invention is directed to a pump with an axial fluid conduit. In one embodiment, the pump of the present invention may include an outer housing and an inner housing positioned within the outer housing. The axial fluid conduit may be defined between the inner housing and the outer housing. A motor may be positioned within the inner housing and an impeller positioned within the fluid conduit and connected to the motor.

Referring now to the figures, and, in particular, to FIGS. 1-2 and 5-6, one embodiment will be described. In this embodiment, the pump 10 may include an outer housing 20 and an inner housing 30 positioned within outer housing 20. A fluid conduit 40 may be defined between outer housing 20 and inner housing 30. A motor 50 may be positioned within inner housing 30 and an impeller 60 positioned within fluid conduit 40 and connected to motor 50. The connection may be any attachment known to those of skill in the art.

Outer housing 20 may be constructed in any manner and of any material(s) that render pump 10 sufficiently durable for its intended application and provide a suitable outer wall for fluid conduit 40. For example, outer housing 20 may be constructed of a lightweight, inexpensive, durable, and fluid-tight material. Outer housing 20 may also be shaped such that it is not cumbersome. For example, outer housing 20 may be ergonomically designed. Materials for construction of outer housing 20 include a wide variety of relatively rigid thermoplastics, such as polyvinyl chloride (PVC) or acrylonitrile-butadiene-sytrene (ABS). However, outer housing 20 may also be constructed of other materials, such as metals, metal alloys, and the like.

Outer housing 20 may be constructed in any shape capable of containing an inner housing 30. For example, outer housing 20 may be constructed generally cylindrically. In some embodiments, outer housing 20 may be larger (e.g., have a larger diameter) where it contains inner housing 30, and smaller (e.g., have a smaller diameter) at an inlet 22 and an outlet 24 of outer housing 20. It should be understood that inlet 22 and outlet 24 have been labeled arbitrarily and that fluid can be moved through pump 10 in either direction. For example, pump 10 may be operated in a first direction to push air from inlet 22 to outlet 24 or in a second direction to pull air from outlet 24 to inlet 22.

Inlet 22 may be constructed to facilitate air flow into fluid conduit 40. For example, inlet 22 may be constructed to prevent blockage of inlet 22. In one embodiment, inlet 22 includes protrusions 26 to inhibit blockage of inlet 22. Inlet 22 may also be constructed to prevent foreign objects from contacting impeller 60. For example, inlet 22 may be constructed to have multiple small openings that are relatively difficult for a foreign object, such as a finger, to enter. In a preferred embodiment, protrusions 26 of inlet 22 are constructed as slats, inhibiting foreign objects from contacting impeller 60.

Outlet 24 may be constructed to provide fluid to a desired location. For example, outlet 24 may be constructed to provide fluid to an inflatable device. In one embodiment, outlet 24 includes structure to lock to an inlet of an inflatable device and to bias a valve of the inlet to an open position when the pump is moving fluid to the inflatable device. In another embodiment, the pump may include a solenoid to bias open the valve when the pump is adding fluid to, drawing fluid from, the inflatable device Inner housing 30 may also be constructed in any manner and of any material(s) that are suitable for containment within outer housing 20, for serving as the inner wall of fluid conduit 40 and for containing motor 50. For example, inner housing 30 may be constructed to fit within outer housing 20, so as to provide the fluid conduit 40. In one embodiment, inner housing 30 is constructed such that it is evenly spaced from an inner surface of outer housing 20. The shape of inner housing 30 may be selected to be compatible with the shape of outer housing 20. For example, where outer housing 20 is generally cylindrical, inner housing 30 may also be generally cylindrical.

Inner housing 30 may also be constructed to securely contain motor 50. For example, inner housing 30 may include internal structure to maintain motor 50 in a desired location. Inner housing 30 may include structure to hold motor 50 in a desired location without allowing undesired vibration or noise. In one embodiment, inner housing 30 may also be constructed to contain one or more batteries to provide electrical power to motor 50. Inner housing 30 may be constructed of any material(s) sufficiently durable to contain motor 50 and suitable for use with the fluid to be pumped. For example, inner housing 30 may be constructed out of any of the same materials as outer housing 20 described supra.

Fluid conduit 40 may be defined by the construction of outer housing 20 and inner housing 30. Fluid conduit 40 may provide sufficient space for fluid flow, so as not to create a significant pressure drop. Fluid conduit 40 may also be regular in shape and substantially free of irregularities that may interfere with efficient fluid flow, potentially creating turbulence, noise and pressure loss.

Fluid conduit 40 may include structure to improve the flow of fluid through fluid conduit 40 and enhance pressurization. Improving the flow through fluid conduit 40 may decrease turbulence and generally result in a pump that is quieter and more efficient. Flow is preferably directed such that the fluid is not forced to make any sudden changes in direction. Fluid conduit 40 is generally axial in direction and impeller 60 will generally impart a rotational force on the fluid relative to the axis of fluid conduit 40. Accordingly, any structure included to improve the flow of fluid through fluid conduit 40 is preferably constructed so as to not inhibit the generally axial movement of fluid through fluid conduit 40, and may allow for the rotation of fluid within fluid conduit 40.

Inefficient fluid flow is preferred to be avoided throughout the length of fluid conduit 40. Accordingly, in a preferred embodiment, the pump is provided with structure to improve the flow of fluid through fluid conduit 40 and enhance pressurization, the structure occupying a majority of fluid conduit 40. The structure for improving the fluid flow preferably occupies at least 75% of the length of fluid conduit 40, even more preferably is 90% of the length of fluid conduit 40, and most preferably substantially all of the length of fluid conduit 40, improving flow throughout fluid conduit 40. By way of illustration, what is meant by the structure occupies a majority of fluid conduit 40 is that the structure extends at least half way through the length of fluid conduit 40, not that it fills more than half the void space in fluid conduit 40. A structure occupying the majority of fluid conduit 40 is substantially different from an arrangement that simply directs fluid from an impeller into an open fluid conduit because it controls the fluid flow through a greater portion of fluid conduit 40 and thus is better able to improve fluid flow.

Figure 3:
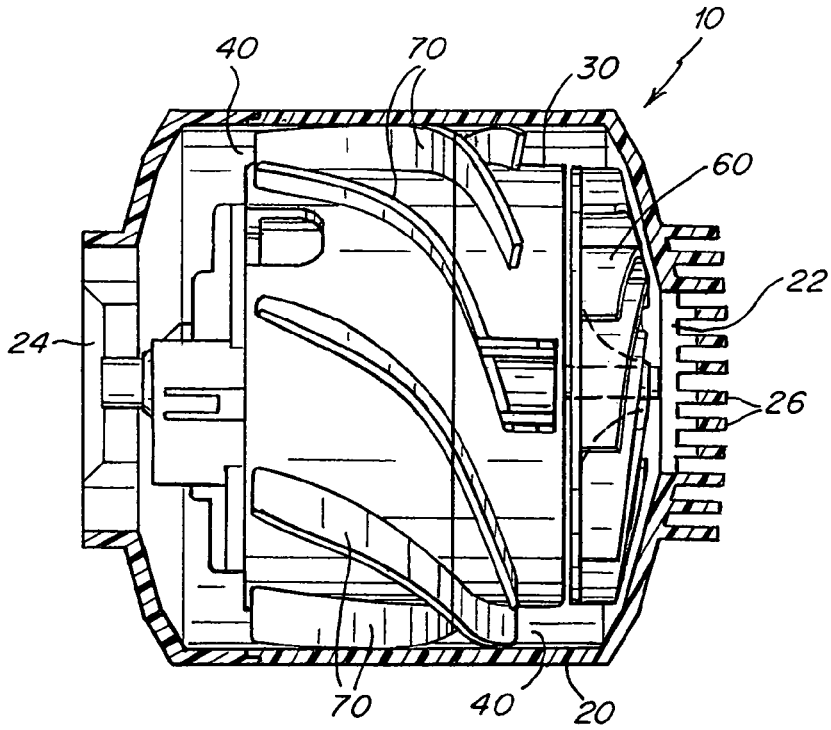
FIG. 3 is a cross-sectional, elevational view of a pump according to another embodiment of the present invention.
Figure 4:
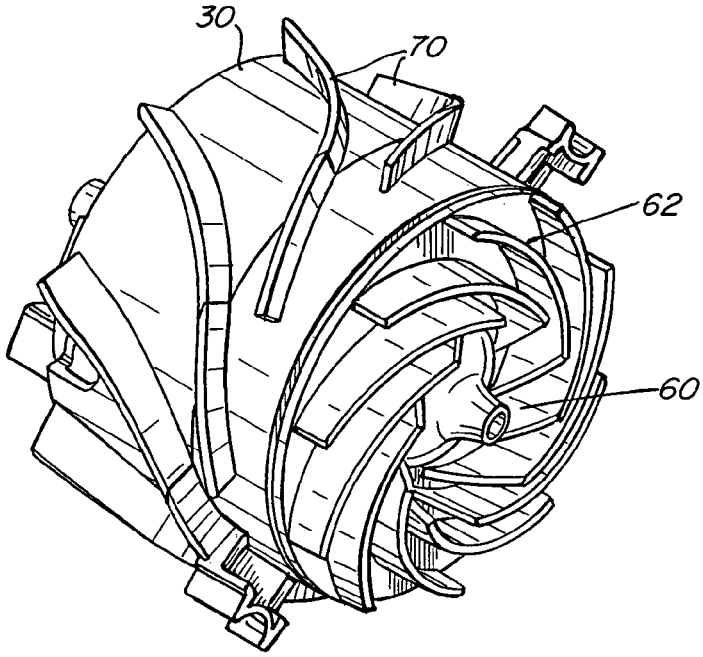
FIG. 4 is a perspective, elevational view of one aspect of the present invention.
Figure 5:
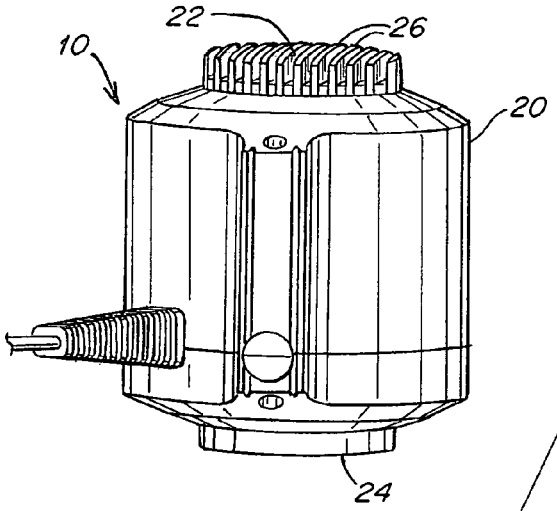
FIG. 5 is a side view of a pump according to one embodiment of the present invention.
Figure 6:
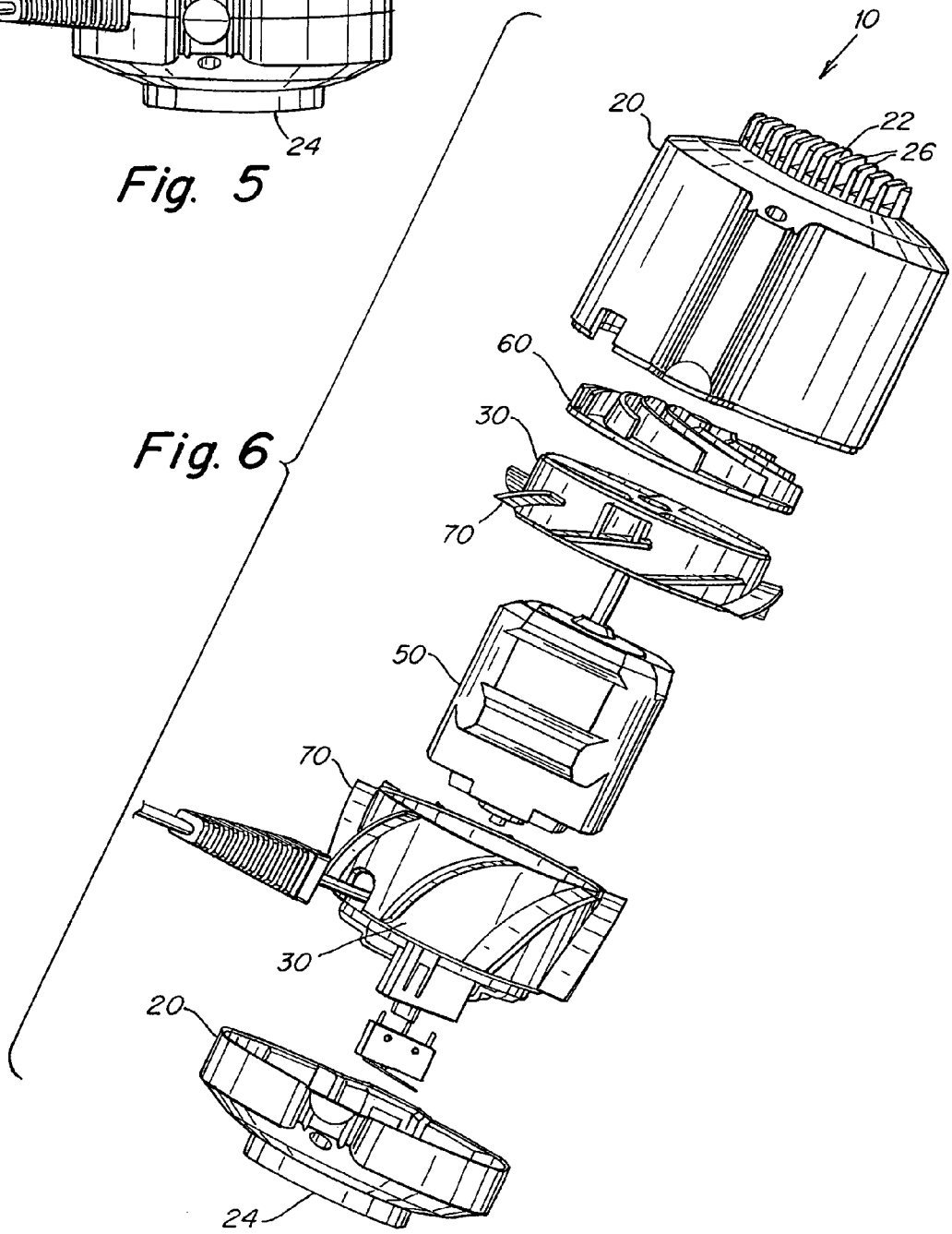
FIG. 6 is an exploded view of the pump of FIG. 6.

In one embodiment, structure to improve the flow of fluid through fluid conduit 40 and enhance pressurization includes one or more structures that direct flow of fluid. For example, referring to FIGS. 3-4 and 6, fluid conduit 40 may include vanes 70 shaped to improve fluid flow through fluid conduit 40. Vanes 70 may be constructed to direct fluid flow within fluid conduit 40 and to bridge fluid conduit 40 from an inner surface of outer housing 20 to an outer surface of inner housing 30, forcing fluid to flow through the channels defined by the vanes. However, it should be understood that vanes 70 need not extend between the inner surface of outer housing 20 and the outer surface of inner housing 30 in all embodiments, or throughout the entire fluid conduit in such embodiments where they do so extend.

Vanes 70 may be constructed to minimize any abrupt changes in fluid flow associated with inefficient flow and increased pressure drop. For example, vanes 70 may be swept in a direction of the rotation imparted by impeller 60, and may direct the flow generally axially along fluid conduit 40. As illustrated, in one embodiment, vanes 70 straighten along the length of fluid conduit 40, allowing them to gradually redirect the air from primarily rotational movement to primarily axial movement. Vanes 70 are preferably free of any rough edges or dead end pockets that may increase fluid resistance.

It should be appreciated that structure to improve the flow of fluid through fluid conduit 40 and enhance pressurization may be particularly useful where fluid conduit 40 is relatively narrow. For example, where it is desired to make pump 10 portable, yet powerful, it may be desired to make inner housing 30 relatively large to house a larger motor, while making outer housing 20 relatively small to reduce the overall size of the device. In such an embodiment, fluid conduit 40 may be relatively narrow. For example, the average distance between an inner surface of outer housing 20 to an outer surface of inner housing 30 may preferably be about 25%, more preferably about 10%, even more preferably about 5%, or less of the average diameter of outer housing 20. In the illustrated embodiment, the average distance between the inner surface of outer housing 20 to the outer surface of inner housing 30 is about 8% of the average diameter of outer housing 20. The narrowness of fluid conduit 40 may itself act as a structure to improve the flow of fluid, directing it axially along the fluid conduit, rather than allowing it to enter a relatively open area. Accordingly, a narrow fluid conduit may be sufficient is some embodiments to reduce inefficient flow.

Fluid conduit 40 may also include structure to maintain the shape of fluid conduit 40. For example, fluid conduit 40 may include structure to secure inner housing 30 relative to outer housing 20. In one embodiment, this structure may include one or more struts connecting an inner surface of outer housing 20 to the outer surface of inner housing 30. In another embodiment, one or more vanes 70 serve to both direct the fluid flow and maintain the relationship between the inner and outer housings.

Motor 50 may be any device capable of rotating impeller 60 to produce fluid flow through pump 10. For example, motor 50 may be a conventional electric motor. In one embodiment, motor 50 is preferably an efficient, lightweight motor. Motor 50 may also be relatively small, to reduce the overall size of pump 10. However, it is to be appreciated that even for a small overall size pump, the motor may still be relatively large compared to the overall size of the pump where it is desired to provide more pumping power.

Impeller 60 may be constructed in any manner and of any material(s) that allow impeller 60 to move fluid when rotated by motor 50. For example, impeller 60 may be constructed with fins 62 capable of forcing fluid into or out of pump 10, depending on the direction of rotation of impeller 60. Impeller 60 may be made of any material capable of maintaining a desired shape of impeller 60. For example, impeller 60 may be constructed of durable and lightweight material that is compatible with the fluid to be used in pump 10. For example, impeller 60 may be constructed of a thermoplastic, such as those mentioned for use in construction of outer housing 20.

Figure 7:
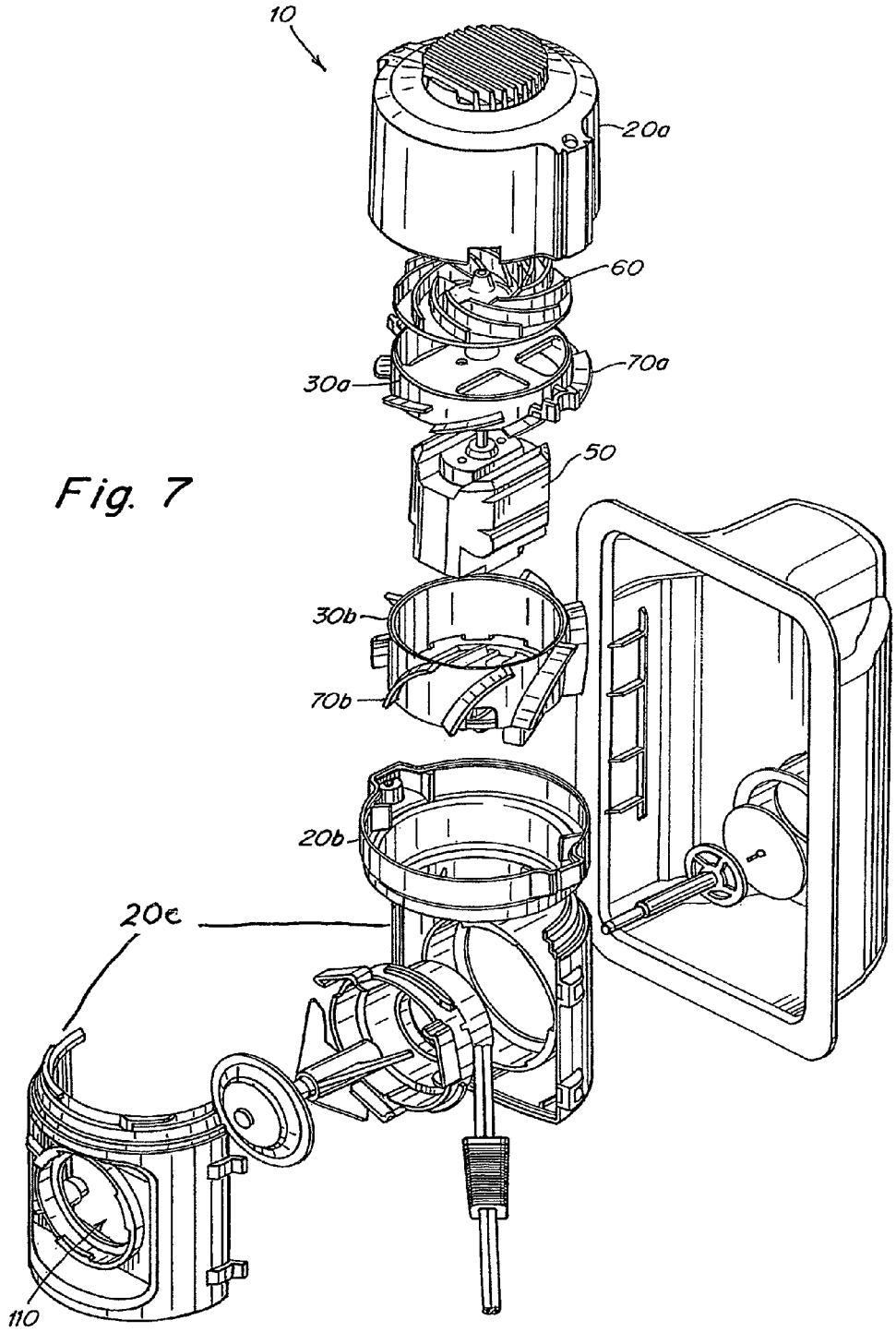
FIG. 7 is an exploded view of one aspect of the present invention.
Figure 8:
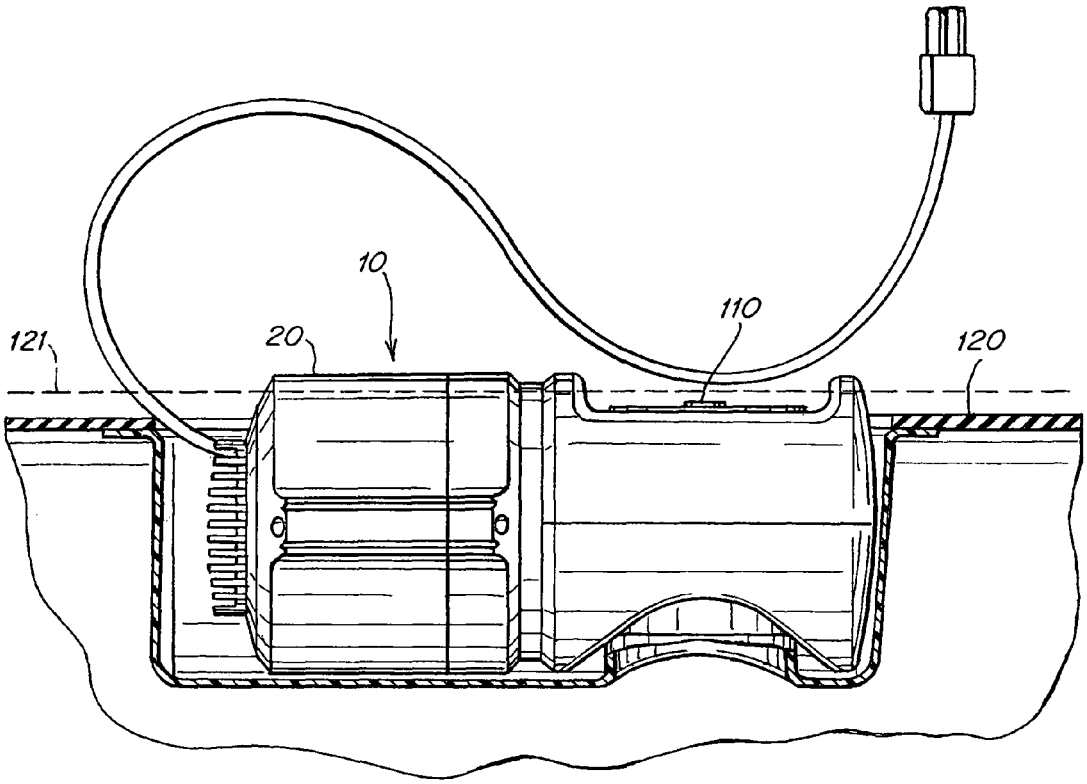
FIG. 8 is a cut-away view of the aspect of FIG. 7.
Figure 9:
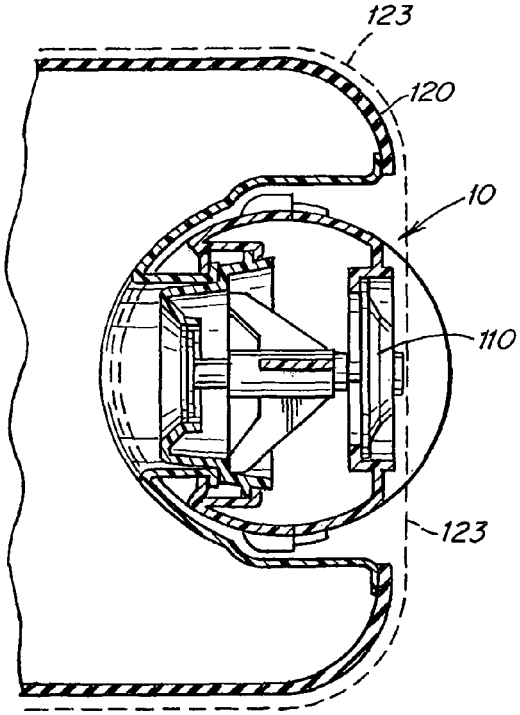
FIG. 9 is a cross-sectional view of the aspect of FIG. 7.

Referring to FIGS. 7-9, according to the present invention pump 10 may be used in a variety of ways. For example, pump 10 may be an independent device, such as a hand holdable pump, and may be placed in contact or connected with an inflatable device when it is desired to inflate the device, typically at a valve 110. In another embodiment, pump 10 may be incorporated into the inflatable device, detachably or permanently. One example embodiment of a pump 10 according to the present invention will now be described with reference to FIGS. 7-9.

In the example embodiment, pump 10 may be connected to a substantially fluid impermeable bladder 120 in an inflatable device. Where pump 10 is connected to bladder 120, pump 10 may be configured so that it does not interfere with the use of the inflatable device. For example the inflatable device may be constructed with pump 10 recessed into bladder 120, as illustrated in FIGS. 7-9. Where pump 10 is recessed within bladder 120, it is an advantage of this embodiment that pump 10 will not interfere with the use of the inflatable device. For example, the exterior profile (total volume and shape) of pump 10 and the inflated device in combination may be substantially the same as the exterior profile of the inflated device absent the combination, thus reducing the opportunity for pump 10 to impact or interfere with the use of the inflatable device. For example, where pump 10 is located within bladder 120 in a mattress application, it allows an inflatable standard sized mattress to fit into a standard sized bed frame. Where pump 10 is located within bladder 120, it may be sized such that it will not come into contact with bladder 120 when bladder 120 is inflated, except at the point(s) of connection. Accordingly, the pump of the present invention, which may be constructed so as to be small and hand-holdable, may be useful in such an application. For additional information regarding incorporating pumps at least partially within a bladder, see U.S. patent application Ser. No. 09/859,706, which is hereby incorporated by reference in its entirety.

An embedded pump 10 may be powered by conventional household current or by battery power. It should also be understood that pump 10 can be a hand holdable pump that is detachable from the inflatable device and is configured to mate with the inflatable device and to be embedded substantially within the bladder.

Outer housing (comprising multiple portions 20*a*,20*b*and 20*c*) may house other structure in addition to inner housing (comprising two portions 30*a*and 30*b*, and corresponding vanes comprising two portions 70*a*and 70*b*) and motor 50. For example, outer housing may include fluid control structure such as valves. Valves may be operated manually, by using a solenoid, or using other conventional techniques. The structure to operate the valve may also be included within outer housing. For example, the outer housing can include portions 20*a*, 20*b*and 20*c*, where the portion 20*c*includes structure to operate the valve.

Having thus described certain embodiments of the present invention, various alterations, modifications and improvements will be apparent to those of ordinary skill in the art. Such alterations, variations and improvements are intended to be within the spirit and scope of the present invention. Accordingly, the foregoing description is by way of example and is not intended to be limiting. The present invention is limited only as defined in the following claims and the equivalents thereto.

What is claimed is:

1. An inflatable device comprising:

a fluid controller including:

a valve assembly including a valve;

a pump for moving air, the pump fluidly coupled to the valve and including:

an outer housing including an inlet configured to fluidly couple the pump to ambient;

an inner housing located within the outer housing and defining an air conduit between the inner housing and the outer housing;

a motor including a stator at least partly positioned within the inner housing; and a plurality of vanes positioned within the air conduit for a majority of a length of the air conduit; and an opening mechanism, at least partly located within the outer housing of the pump, the opening mechanism configured to be operational by a user to allow the user to open the valve, wherein the valve fluidly couples the pump to the inflatable device, wherein the fluid controller is configured to allow the user to open the valve with the opening mechanism to release air from within the inflatable device to ambient without aid of the pump, wherein the inflatable device includes an inflatable bladder, wherein a majority of the pump and a majority of the valve assembly are positioned within a profile of the inflatable bladder when the pump is coupled to the valve assembly in a mounted position and orientation, and wherein in the same mounted position and orientation of the pump, the fluid controller is configured to electronically open the valve to permit air to exit the inflatable bladder through the fluid controller and to energize the pump to provide air to the inflatable bladder through the pump and the valve.

2. The inflatable device of claim 1, wherein a majority of the length of the air conduit is located annularly about and a constant distance from a longitudinal axis of the pump.

3. The inflatable device of claim 1, wherein the pump includes an impeller located in the air conduit.

4. The inflatable device of claim 1, wherein the pump includes an impeller including a plurality of fins.

5. The inflatable device of claim 1, wherein each of the plurality of vanes include a sweep.

6. The inflatable device of claim 1, wherein an average distance between an inner surface of the outer housing and an outer surface of the inner housing is less than about 10% of the average diameter of the outer housing.

7. The inflatable device of claim 1, wherein the pump includes an impeller, wherein the impeller is adapted to provide an air flow that is at least partly a rotational air flow at an inlet to the air conduit.

8. The inflatable device of claim 7, wherein the pump includes an axis, wherein the pump moves air through the air conduit parallel to the axis, and wherein the vanes are adapted to provide a substantially linear air flow at an outlet to the air conduit.

9. The inflatable device of claim 1, wherein the pump is sized and configured to be hand held to allow a user to detachably connect the pump to the inflatable device.

10. The inflatable device of claim 1, wherein an axis of the pump is perpendicular to an axis of the valve assembly when the pump is coupled to the valve assembly.

11. The inflatable device of claim 1, wherein the vanes extend at least 90% of the length of a region of the fluid conduit located annularly about the inner housing.

12. The inflatable device of claim 11, wherein the vanes extend for substantially all of the length of the region of the fluid conduit.

13. The inflatable device of claim 12, wherein the vanes extend unbroken for substantially all of their length.

14. The inflatable device of claim 1, wherein the valve assembly is configured to allow the user to manually open the valve.

15. The inflatable device of claim 14, wherein at least a portion of the valve assembly is permanently coupled to the inflatable device.

16. The inflatable device of claim 15, wherein the valve includes a self sealing valve.

17. The inflatable device of claim 16, further comprising a housing configured to provide a socket within a profile of the inflatable bladder, and wherein the pump and the valve assembly are at least partly located in the socket.

18. The inflatable device of claim 17, wherein the socket includes a plurality of walls, and wherein the valve assembly is located at least partly within one wall of the plurality of walls.

19. The inflatable device of claim 18, wherein the valve includes a diaphragm, and wherein the opening mechanism includes a mechanical opening mechanism configured to act on the diaphragm to open the valve.

20. The inflatable device of claim 19, wherein a switch configured for operation by the user acts upon the mechanical opening mechanism.

21. The inflatable device of claim 1, wherein the opening mechanism includes an electro-mechanical opening mechanism which is configured-to allow the user to electrically open the valve.

22. The inflatable device of claim 21, wherein the electro-mechanical opening mechanism includes a solenoid.

23. The inflatable device of claim 1, wherein the opening mechanism includes a mechanical opening mechanism configured to allow the user to mechanically open the valve.

24. The inflatable device of claim 1, further comprising an adjustment device connected to the fluid controller by a cord, wherein the adjustment device is configured to allow the user to open the valve with the opening mechanism using the adjustment device.

25. An inflatable device comprising:

a fluid controller including:

a valve assembly including a valve;

a pump for moving air, the pump fluidly coupled to the valve and including:

an outer housing including an inlet configured to fluidly couple the pump to ambient;

an inner housing located within the outer housing and defining an air conduit between the inner housing and the outer housing;

a motor including a stator at least partly positioned within the inner housing; and a vane positioned within the air conduit and extending for substantially all of a length of the portion of the air conduit, an opening mechanism, at least partly located within the outer housing of the pump, the opening mechanism configured to be operational by a user to allow the user to open the valve, wherein the valve fluidly couples the pump to the inflatable device, wherein the fluid controller is configured to allow the user to open the valve with the opening mechanism to release air from within the inflatable device to ambient without aid of the pump, wherein the inflatable device includes an inflatable bladder, wherein a majority of the pump and a majority of the valve assembly are positioned within a profile of the inflatable bladder when the pump is coupled to the valve assembly in a mounted position and orientation, and wherein in the same mounted position and orientation of the pump, the fluid controller is configured to open the valve to permit air to exit the inflatable bladder through the fluid controller and to energize the pump to provide air to the inflatable bladder through the pump and the valve.

26. The inflatable device of claim 25, wherein the vane extends between an inner surface of the outer housing, and an outer surface of the inner housing.

27. The inflatable device of claim 25, wherein the vane has a sweep.

28. The inflatable device of claim 27, wherein the sweep of the vane gradually redirects fluid flowing through the air conduit from primarily rotational motion to primarily axial motion.

29. The inflatable device of claim 25, wherein the pump is externally accessible when coupled to the valve assembly.

30. The inflatable device of claim 25, wherein the pump is coupled to the valve assembly in a position, and in the position the pump is sized and adapted to permit air to exit the inflatable device through the pump and to be provided to the inflatable device through the pump.

31. The inflatable device of claim 25, wherein the pump is configured to be hand held to allow a user to detachably connect the pump to the inflatable device.

32. The inflatable device of claim 25, wherein the pump is an electrically powered pump.

33. The inflatable device of claim 25, wherein the opening mechanism includes a mechanical opening mechanism configured to allow the user to mechanically open the valve.

34. The inflatable device of claim 25, wherein the opening mechanism includes an electro-mechanical opening mechanism which is configured to allow the user to electrically open the valve.

35. An inflatable device comprising:

a valve assembly including a valve fluidly coupled to the inflatable device;

a pump for moving air, the pump including:

an outlet configured to fluidly couple to the valve;

an outer housing including an inlet configured to fluidly couple the pump to ambient;

an inner housing located within the outer housing and defining an air conduit between the inner housing and the outer housing;

a motor at least partly positioned within the inner housing;

at least one vane positioned within the air conduit and an opening mechanism, at least partly located within the outer housing of the pump, the opening mechanism configured to be operational by a user, so as to allow the user to open the valve and release air from within the inflatable device to ambient without aid of the pump, wherein the inflatable device includes an inflatable bladder, wherein a majority of the pump and a majority of the valve assembly are positioned within a profile of the inflatable bladder when the pump is coupled to the valve assembly in a mounted position and orientation, and wherein in the same mounted position and orientation of the pump, the fluid controller is configured to open the valve to permit air to exit the inflatable bladder through the fluid controller and to energize the pump to provide air to the inflatable bladder through the pump and the valve.

* * * * *